US008537052B2

(12) United States Patent
Furutani et al.

(10) Patent No.: US 8,537,052 B2
(45) Date of Patent: Sep. 17, 2013

(54) ANTENNA AND ELECTRONIC DEVICE EQUIPPED WITH THE SAME

(75) Inventors: Nagahisa Furutani, Kawasaki (JP); Manabu Kai, Kawasaki (JP); Satoru Nogami, Inagi (JP)

(73) Assignees: Fujitsu Limited, Kawasaki (JP); Fujitsu Frontech Limited, Inagi (JP)

( * ) Notice: Subject to any disclaimer, the term of this patent is extended or adjusted under 35 U.S.C. 154(b) by 175 days.

(21) Appl. No.: 12/696,527

(22) Filed: Jan. 29, 2010

(65) Prior Publication Data

US 2010/0214188 A1 Aug. 26, 2010

(30) Foreign Application Priority Data

Feb. 24, 2009 (JP) ..... 2009-041470

(51) Int. Cl.
*H01Q 1/38* (2006.01)

(52) U.S. Cl.
USPC ..... 343/700 MS; 343/702

(58) Field of Classification Search
USPC ..... 343/700 MS, 702, 846
See application file for complete search history.

(56) References Cited

U.S. PATENT DOCUMENTS 5,050,295 A * 9/1991 Sullivan et al. ..... 29/830
6,107,920 A * 8/2000 Eberhardt et al. ..... 340/572.7
6,914,562 B2 7/2005 Forster
7,750,813 B2 * 7/2010 Deavours et al. ..... 340/572.7
7,843,389 B2 * 11/2010 Luk et al. ..... 343/700 MS
2006/0054710 A1 * 3/2006 Forster et al. ..... 235/492
2006/0227053 A1 10/2006 Ishikura
2007/0164868 A1 7/2007 Deavours et al.
2007/0273527 A1 11/2007 Yamagajo et al.
2009/0140947 A1 * 6/2009 Sasagawa et al. ..... 343/845

FOREIGN PATENT DOCUMENTS

FR 2616015 A1 12/1988
JP 2006-157905 A 6/2006
JP 2006-287452 A 10/2006
JP 2007-318323 A 12/2007
WO 2008/054148 A1 5/2008

OTHER PUBLICATIONS

Japanese Office Action dated Jul. 17, 2012, issued in corresponding Japanese Patent Application No. 2009-041470, w/ English translation (5 pages).
Chinese Office Action dated Jun. 4, 2012, issued in corresponding Japanese Patent Application No. 201010116643.4, with English translation (10 pages).

* cited by examiner

*Primary Examiner* — Hoanganh Le
(74) *Attorney, Agent, or Firm* — Westerman, Hattori, Daniels & Adrian, LLP

(57) ABSTRACT

An antenna includes a dielectric substrate, a ground electrode provided on a first surface of the dielectric substrate, a first antenna element and a second antenna elements provided to a second surface of the dielectric substrate, the first and second antenna elements having an identical resonance frequency and an identical Q value, a transmission line connecting the first and second antenna elements, and a feed part provided in the transmission line.

2 Claims, 20 Drawing Sheets

ANTENNA AND ELECTRONIC DEVICE EQUIPPED WITH THE SAME

CROSS-REFERENCE TO RELATED APPLICATION

This application is based upon and claims the benefit of priority of the prior Japanese Patent Application No. 2009-041470, filed on Feb. 24, 2009, the entire contents of which are incorporated herein by reference.

FIELD

A certain aspect of the embodiments discussed herein is related to an antenna and an electronic device equipped with the same.

BACKGROUND

Recently, an RFID (Radio Frequency IDentification) system has been applied for inventory management, merchandise management and distribution management. An exemplary RFID system is configured as follows. A host computer and a reader/writer are connected. A memory having a built-in antenna, called tag, is attached to a managed object. A variety of information related to the managed object (managed object information) is stored in the tag. The managed object information is transferred between the tag and the host computer via the reader/writer. The managed object information in the tag is read out to the host computer, and the managed object information in the host computer is written in the tag. Thus, the managed object information realizes the traceability of the managed object.

Preferably, the antenna employed in the RFD system has a wideband characteristic, a compact size and low profile. It is also preferred that the antenna performance is immune to the property of a member to which the antenna is attached.

There are various proposals for realizing antennas as described above. For example, a proposed antenna has planar antenna elements that are formed on a dielectric substrate and have different resonance frequencies, in which the antenna elements are coupled at a feed point via a transmission line for impedance matching (see Japanese Laid-Open Patent Publication No. 2006-287452). Another proposed antenna functions as a slot antenna in the vicinity of a metal surface and functions as an ordinary antenna away from the metal surface (see U.S. Pat. No. 6,914,562).

SUMMARY

According to an aspect of the present invention, there is provided an antenna including: a dielectric substrate; a ground electrode provided on a first surface of the dielectric substrate; a first antenna element and a second antenna elements provided to a second surface of the dielectric substrate, the first and second antenna elements having an identical resonance frequency and an identical Q value; a transmission line connecting the first and second antenna elements; and a feed part provided in the transmission line.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Nowadays, a wideband antenna and a strip antenna for the multi-band use have been developed for wireless LANs (Local Area Network), cellular phones and UWB (Ultra-Wide Band) systems. Preferably, the RFID system employs wideband, multi-band and downsized antennas. The antennas used in the RFID system are apt to be affected by the ambient environment and are designed to have different frequencies in different countries. More specifically, the RFID tag in the UHF band is assigned 915 MHz in the United States of America, 953 MHz in Japan and 860 MHz in Europe. In order to enable the RFID tag to be worldwide used in the different countries adopting the different frequencies, the antenna is preferably capable of covering the different frequencies. A dipole antenna and a patch antenna, which are typical microstrip antennas, have the following advantages and disadvantages.

Figure 1:
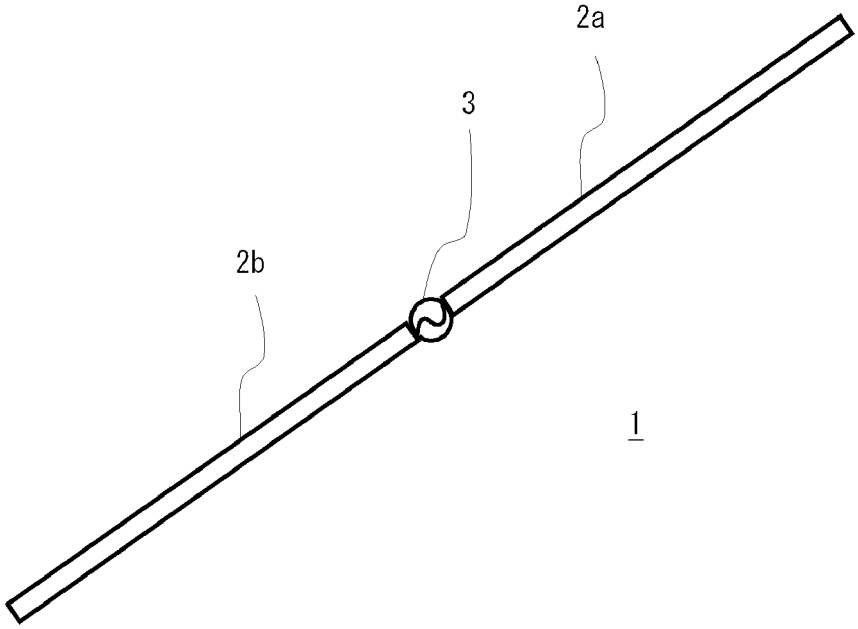
FIG. 1 illustrates a dipole antenna.
Figure 2:
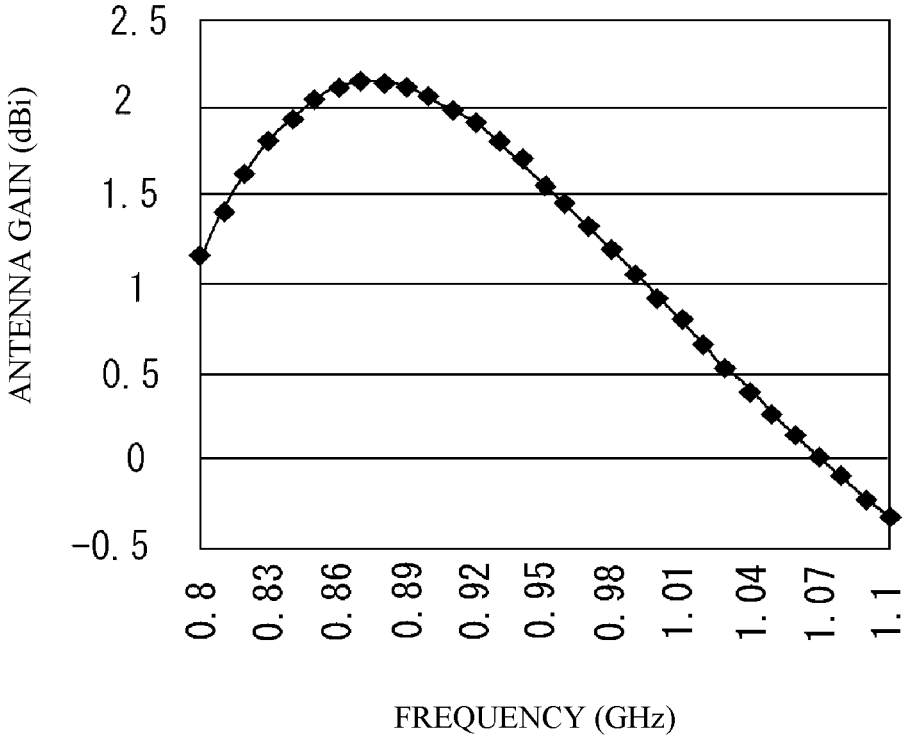
FIG. 2 is a graph of an exemplary antenna gain characteristic of the dipole antenna.
Figure 3:
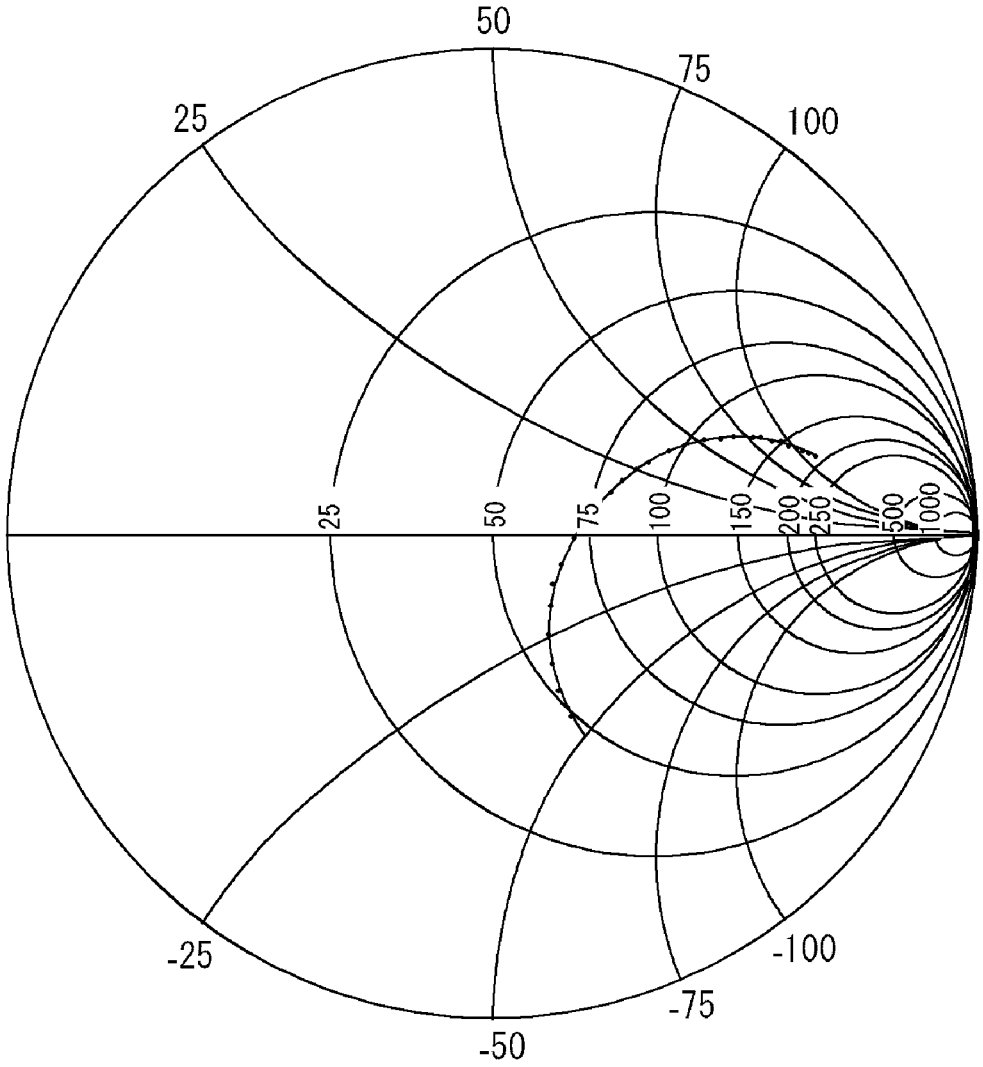
FIG. 3 is a graph of an exemplary feed point impedance of the dipole antenna.

FIG. 1 illustrates an exemplary dipole antenna 1 having a feed point 3 arranged between antenna elements 2*a* and 2*b*. FIG. 2 illustrates an exemplary antenna gain characteristic of the dipole antenna 1, and FIG. 3 illustrates a feed point impedance characteristic of the dipole antenna 1. A wideband bandwidth is realized under the condition of the ideal antenna structure and environment.

If the dipole antenna 1 is bent or curved for downsizing, the dipole antenna 1 will have a narrowed band and a reduced gain. In addition, the curved or bent dipole antenna 1 will more easily be affected by the property of a member such as a metal to which the dipole antenna 1 is attached.

Figure 4:
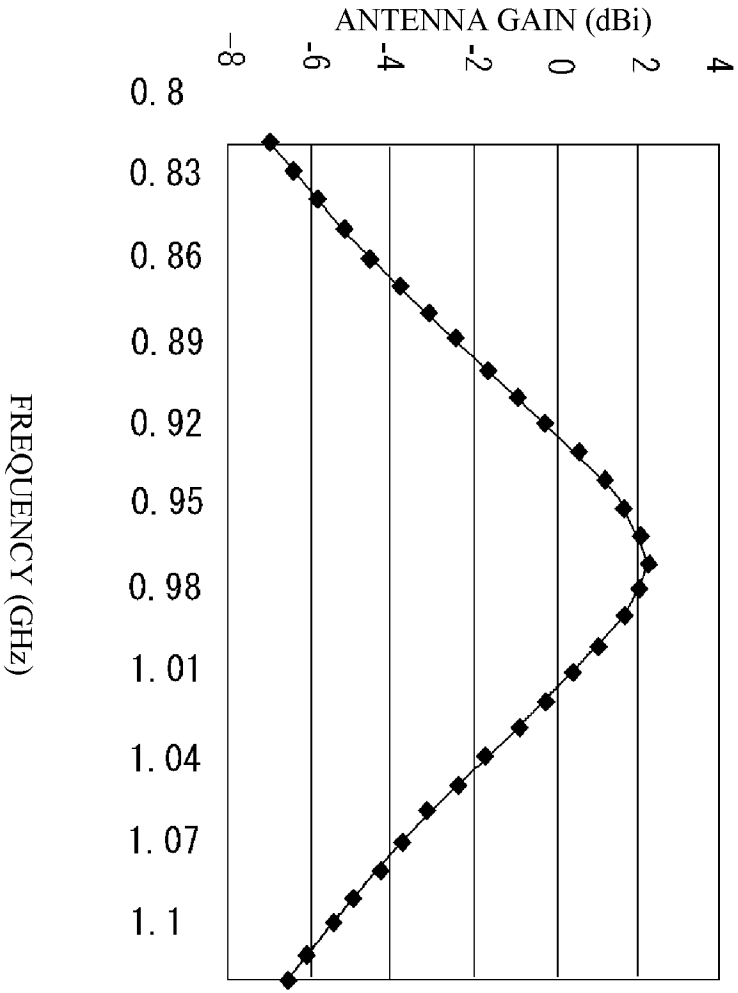
FIG. 4 is a graph of an antenna gain characteristic of a downsized dipole antenna in order to use the dipole antenna as an antenna for an RFID tag.
Figure 5:
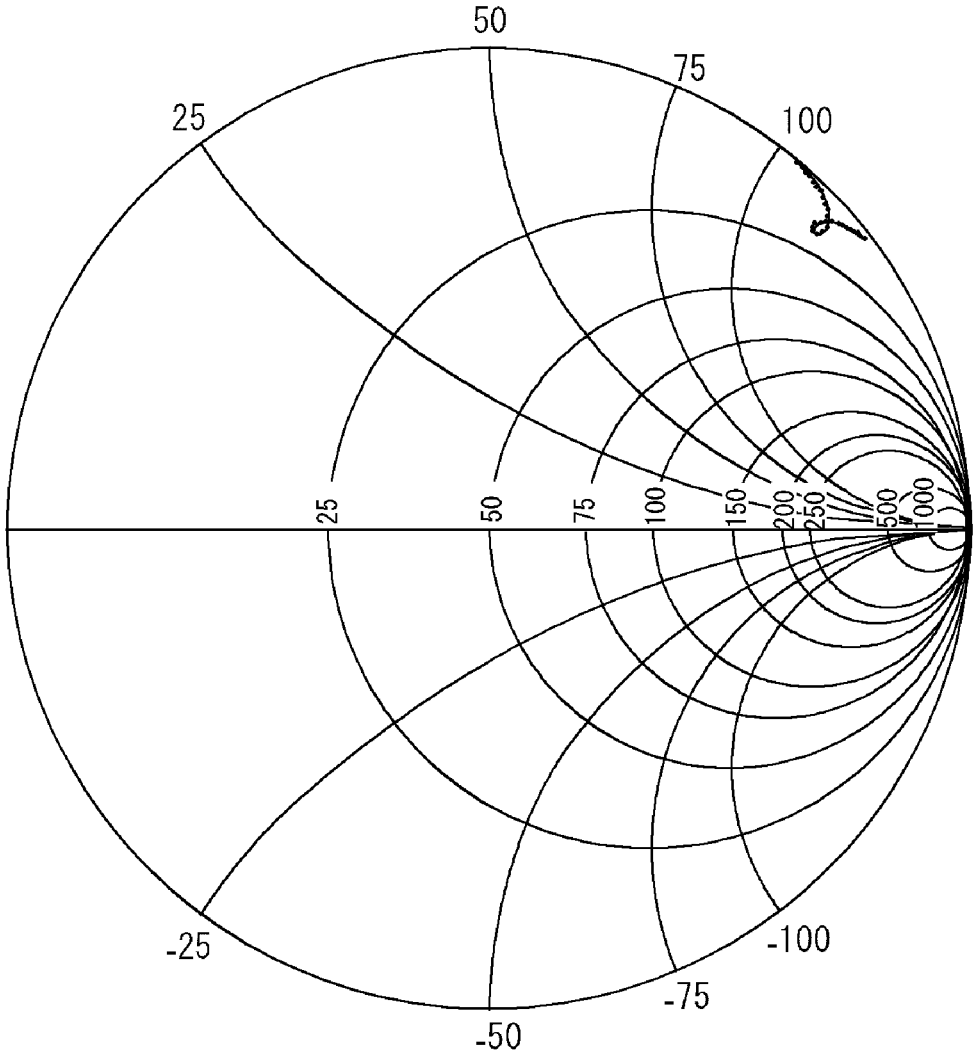
FIG. 5 is a graph of an exemplary feed point impedance characteristic of the downsized dipole antenna.

FIG. 4 illustrates an exemplary antenna gain characteristic of a downsized dipole antenna used as an antenna for the RFID tag, and FIG. 5 illustrates a feed point impedance characteristic of the downsized dipole antenna. FIGS. 4 and 5 illustrate that downsizing of the dipole antenna narrows the band and reduces the antenna gain.

Figure 6:
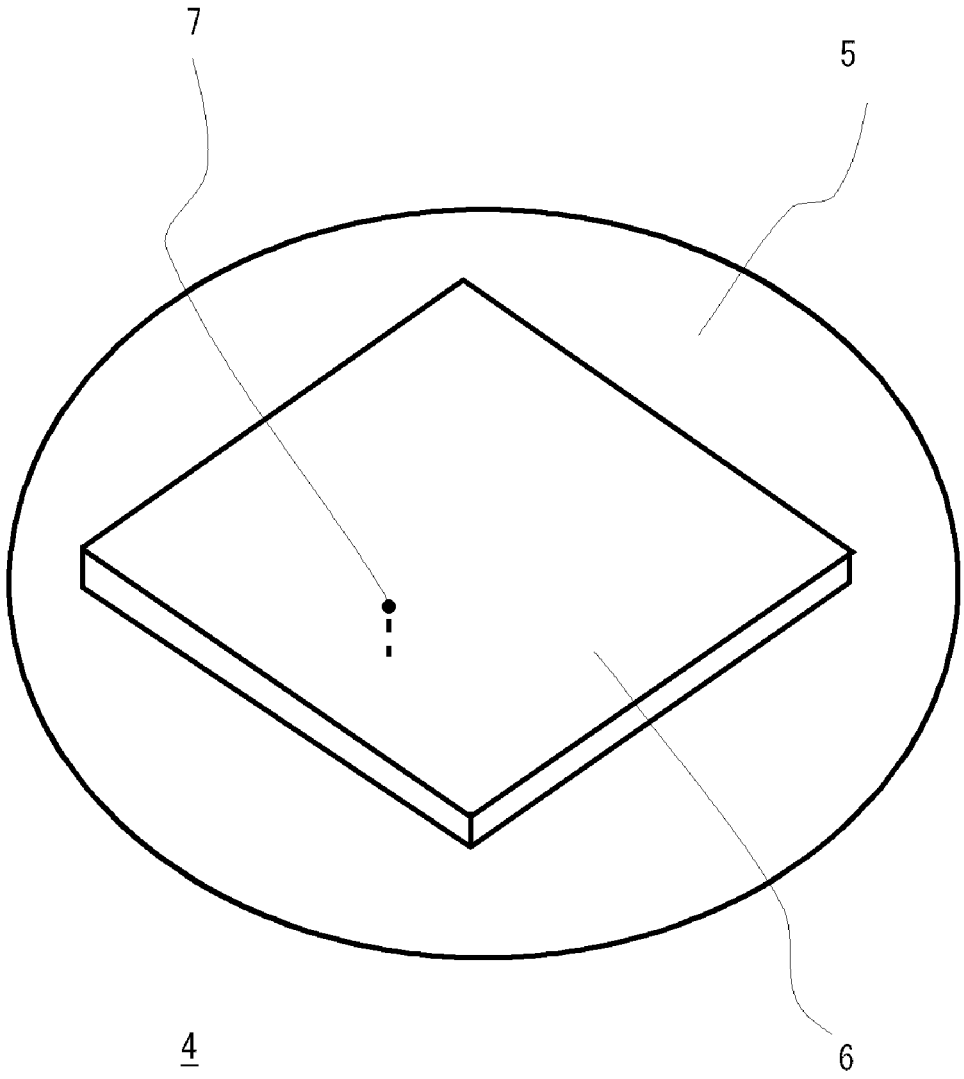
FIG. 6 is a diagram of an antenna using a patch antenna for the RFID tag.
Figure 7:
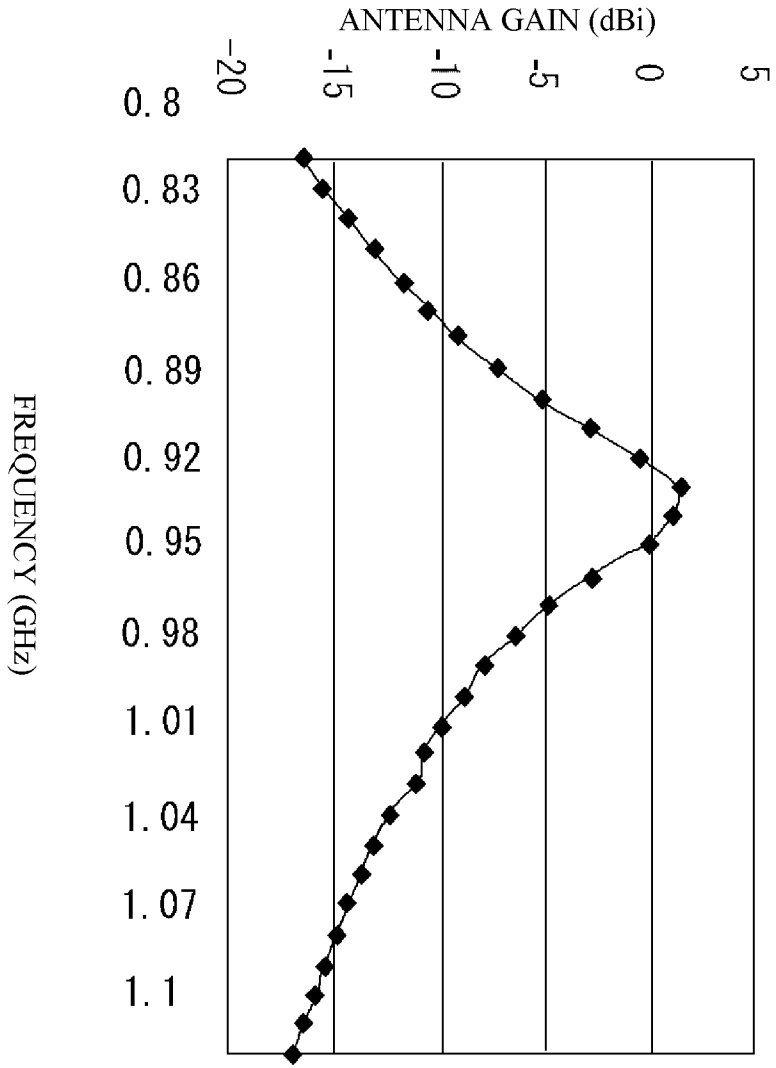
FIG. 7 is a graph of an exemplary antenna gain characteristic of the antenna illustrated in FIG. 6.
Figure 8:
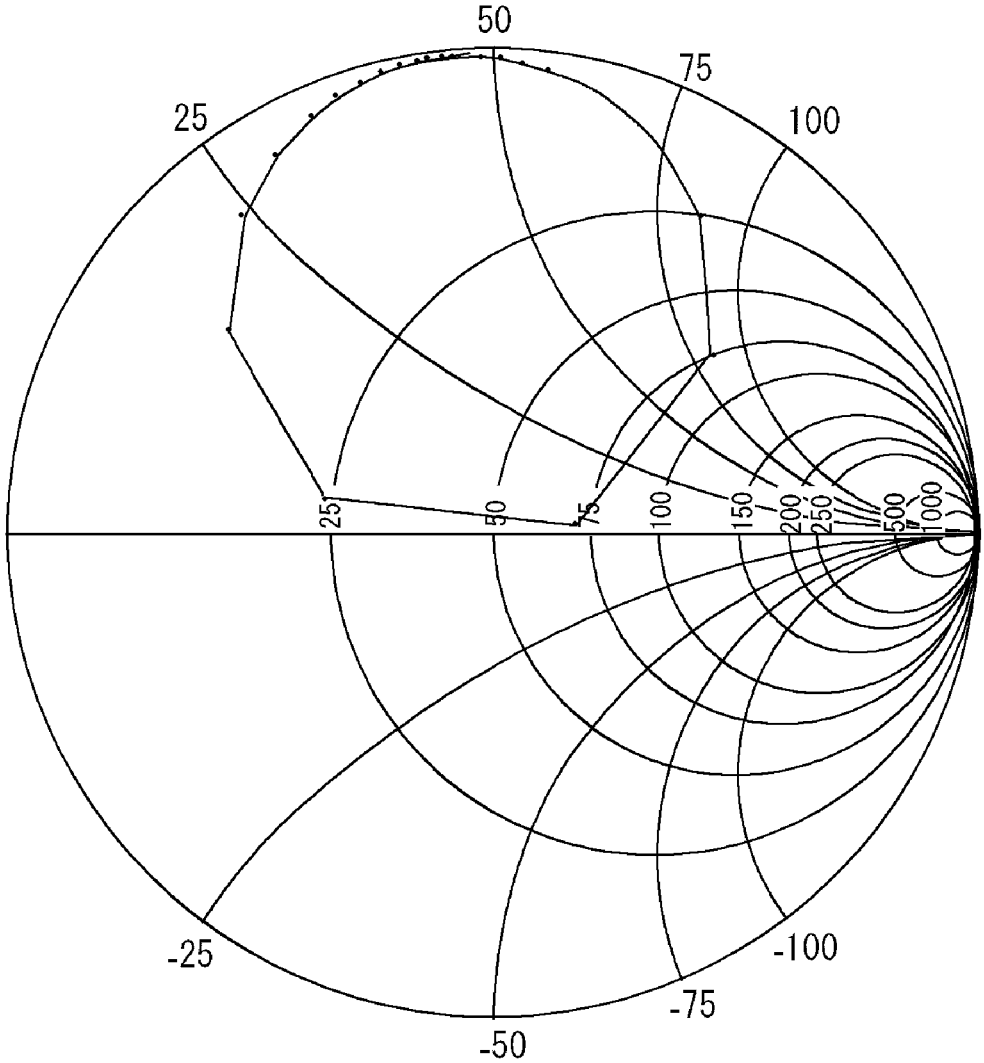
FIG. 8 is a graph of an exemplary feed point impedance characteristic of the antenna illustrated in FIG. 6.

FIG. 6 illustrates an antenna 4 for use in the RFID tag using an ordinary patch antenna. FIG. 7 illustrates an exemplary antenna gain characteristic of the antenna 4. The antenna 4 has a ground member 5, a patch antenna part 6 and a feed point 7.

Figure 9:
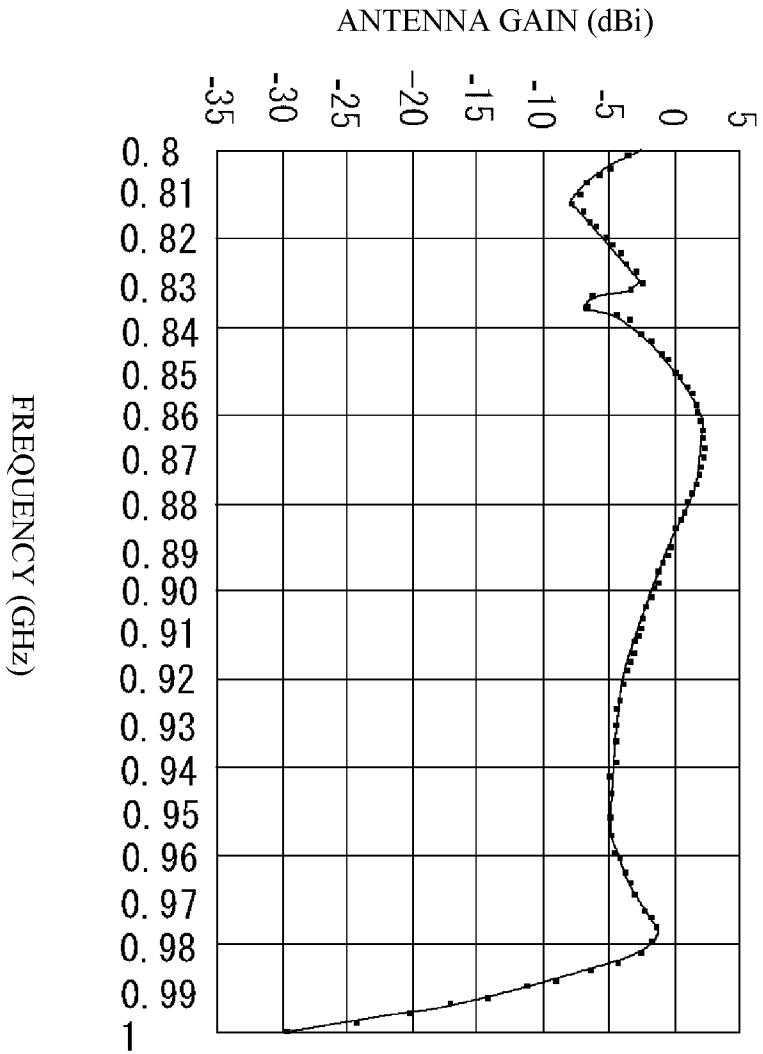
FIG. 9 is a graph of an antenna gain characteristic of an RFID tag oriented patch antenna designed to have a broadened band.
Figure 10:
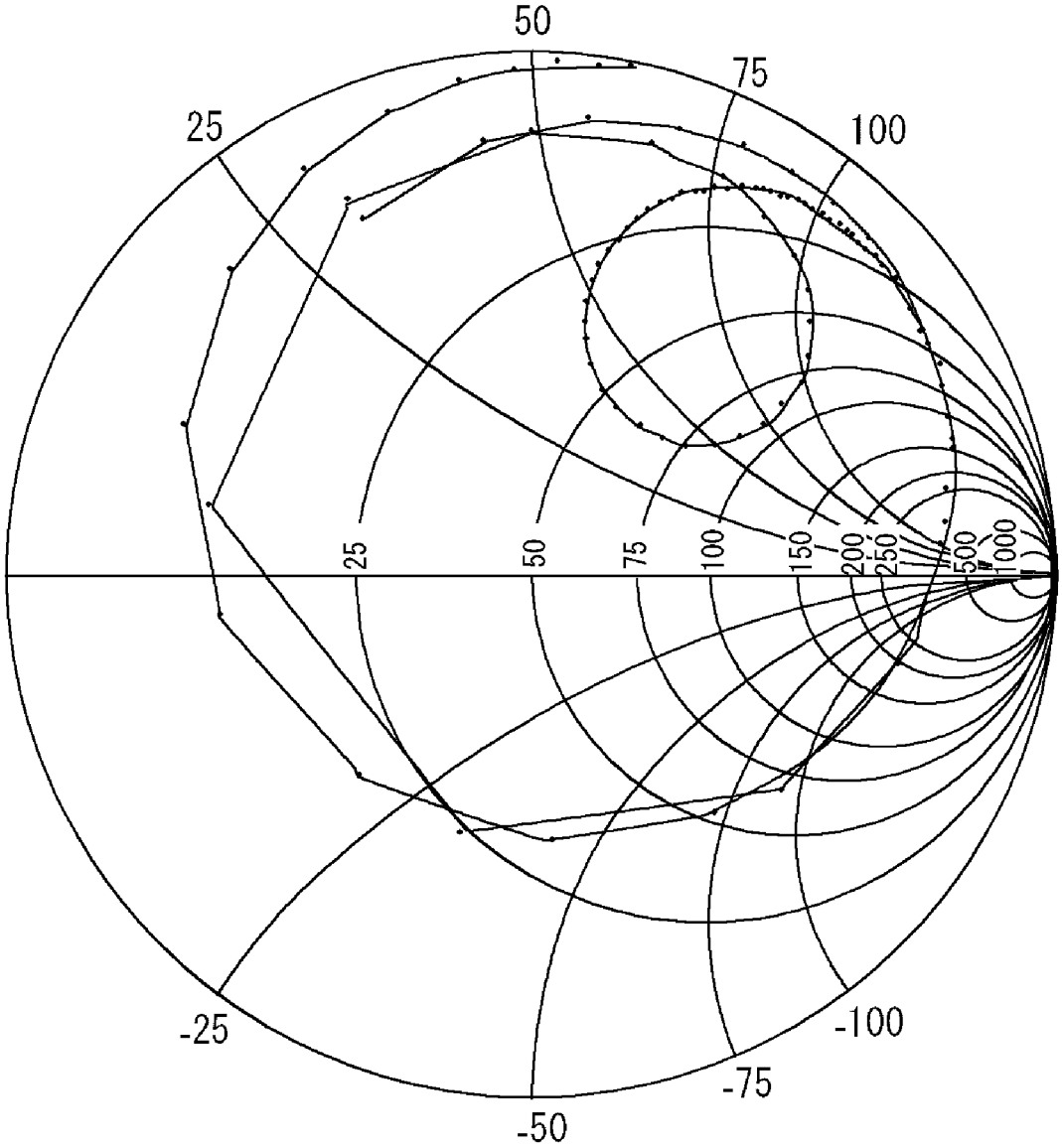
FIG. 10 is a graph of an exemplary feed point impedance characteristic of the patch antenna described with reference to FIG. 9.

The antenna 4 using the patch antenna has a narrow bandwidth of the radiation characteristic, as compared to the dipole antenna. The antenna 4 uses the antenna substrate with the ground member 5, and the radiation pattern is thus obtained on the only one side of the antenna 4. In a case where the ground member 5 is used to attach the antenna 5 to an attachment member, the member may be made of a metal. However, the antenna 4 has a narrow bandwidth. The bandwidth tends to be further narrowed by facilitating the low profile of the RFID tag, that is, by thinning the antenna substrate. Generally, the bandwidth of the patch antenna may be broadened by coupling multiple resonators in various ways and thickening the antenna substrate. For example, the antenna substrate is set equal to or greater than 3 mm. FIG. 9 illustrates an exemplary antenna gain characteristic of a patch antenna for the RFID tag designed to broaden the bandwidth. FIG. 10 illustrates an exemplary feed-point impedance characteristic. As illustrated in FIG. 9, the broadening of the bandwidth degrades the antenna gain characteristic. The antenna substrate is thick.

Generally, the antenna may be designed as follows. The strip antenna uses a resonator formed on the antenna substrate and has the feed point at a specific position on the resonator at which the antenna is conjugate-matched with the output impedance of a transmitter. More specifically, the antenna such as the dipole antenna or the patch antenna primarily uses one resonator, and has the feed point at a specific position on the resonator at which the antenna is conjugate-matched with the impedance of a signal source. A matching circuit for conjugate matching may be used.

The patch antenna may employ multiple resonators having different resonance frequencies in order to broaden the band. However, in some cases, a satisfactory wideband characteristic is not obtained.

As described above, it is difficult to realize the microstrip antenna for the RFID tag in the UHF band that simultaneously achieves a reduced size, a broader bandwidth, improved low profile and adaptation to a metal.

According to an aspect of embodiments, there is provided an antenna capable of achieving a reduced size, a broader bandwidth, improved low profile and metal attachment.

First Embodiment

Figure 11:
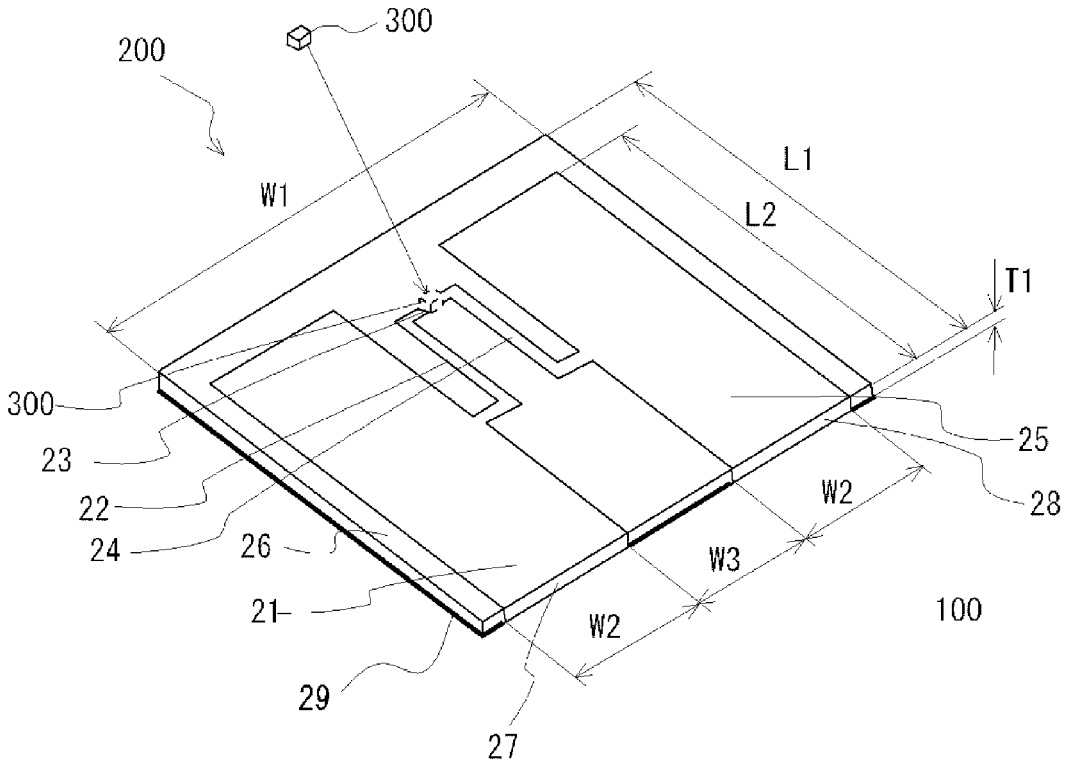
FIG. 11 is a perspective view of a tag employed in an RFID system in accordance with a first embodiment.

FIG. 11 is a perspective view of a tag 100 used for the RFID systems. The tag 100 has an antenna 200 equipped with a circuit chip such as a large scale integration (LSI) chip 300. The tag 100 is an exemplary example of an electronic device in accordance with an aspect of the present invention. In practice, the tag 100 may be covered with a protection member, which is not illustrated for the sake of simplicity.

The antenna 200 has a dielectric substrate 26 and a ground electrode 29 provided on a surface of the dielectric substrate 26. The antenna 200 has a first antenna element 21 and a second antenna element 25, which are provided on the other surface of the dielectric substrate 26. Further, the antenna 200 has a first transmission line 22 and a second transmission line 24, which are used to connect the first antenna element 21 and the second antenna element 25. The first transmission line 22 extends from the first antenna element 21, and the second transmission line 24 extends from the second antenna element 25. An end of the first transmission line 22 and an end of the second transmission line 24 face each other. The ends of the transmission lines 22 and 24 that face each other form a feed part 23. The first antenna element 21 is connected to the ground electrode 29 via an electrode 27 provided on an end of the dielectric substrate 26. Similarly, the second antenna element 25 is connected to the ground electrode 29 via an electrode 28 provided on the end of the dielectric substrate 26.

The antenna 200 thus configured may have the following exemplary dimensions. The length L1 of the dielectric substrate 26 is equal to 38 mm, and the width W1 thereof is equal to 40 mm. The thickness T1 of the dielectric substrate 26 is equal to 1 mm. The length L2 of the first antenna element 21 is equal to 36 mm, and the width W2 thereof is equal to 12 mm. The second antenna element 25 has the same dimensions as those of the first antenna element 21. The width W3 between the first antenna element 21 and the second antenna element 25 is set equal to 12 mm.

The first antenna element 21 and the second antenna element 25 may have the following conditions. The first antenna element 21 and the second antenna element 25 are printed on the dielectric substrate 26 and have short-circuited ends and open-circuited ends. The first antenna element 21 having the short-circuited end and the open-circuited end functions as a λ/4 microstrip resonator that resonates at a frequency $f_{R1}$ described below:

$$f_{R1}=c/4(L2+T1)\sqrt{\epsilon_r}$$

where L2+T1 denotes the length of the first antenna element 21, c is the velocity of light and $\epsilon_r$ is the dielectric constant of the dielectric substrate 26. Similarly, the second antenna element 25 functions as a λ/4 microstrip resonator that resonates at a frequency $f_{R2}$ described below:

$$f_{R2}=c/4(L2+T1)\sqrt{\epsilon_r}$$

where L2+T1 denotes the length of the second antenna element 25. Thus, the antenna 200 has a structure with the two λ/4 microstrip resonators. It is noted that the lengths L2+T1 of the first and second antenna elements 21 and 25 consider the thickness of the dielectric substrate 26.

The first antenna element 21 and the second antenna element 25 have the following relations.

$$f_{R1}=f_{R2}$$

$$Q1=Q2$$

Where Q1 is the Q value of the first antenna element 21 and Q2 is the Q value of the second antenna element 25.

The Q value can be written as a general expression as follows:

$$Q=(1/R)\times(L/C)^{1/2}$$

The antenna element functioning as a resonator may be represented in the form of an equivalent circuit in which an inductive element L and a capacitive element C are combined. When the antenna element is considered as a resonator, multiple antenna elements connected by transmission lines function as follows.

The antenna element operates as a capacitive element within a range shorter than λ/4 in the distance from the open-circuited end to the input/output port, and operates as an inductive element within a range shorter than λ/4 in the distance from the short-circuited end to the input/output port in accordance with the theory of distribution constant. The characteristic impedance of the antenna element arranged on the dielectric substrate is defined by the dimensions thereof and the thickness of the dielectric substrate.

Thus, the Q value of the first antenna element 21 is defined by the dimensions of the first antenna element 21, the position of the input/output port, and the thickness of the dielectric substrate 26. Similarly, the Q value of the second antenna element 25 is defined by the dimensions of the second antenna element 25, the position of the input/output port and the thickness of the dielectric substrate 26.

The lengths L2 and the widths W2 of the first and second antenna elements 21 and 25 and the thickness T1 of the dielectric substrate 26 are determined so as to obtain a desired Q value.

The lengths of the first transmission line 22 and the second transmission line 24 used to connect the first antenna element 21 and the second antenna element 25 is λ/4 of the resonance frequencies fR1 and fR2 of the first and second antenna elements 21 and 25 (fR1=fR2).

The position of the feed part 23 is selected so that the antenna is conjugate-matched with the impedance of the signal source. The feed part 23 includes the LSI chip 300 for RFID. The feed part 23 is supplied with power. The antenna 200 forms the tag 100 along with the LSI chip 300 arranged in the feed part 23.

Figure 12:
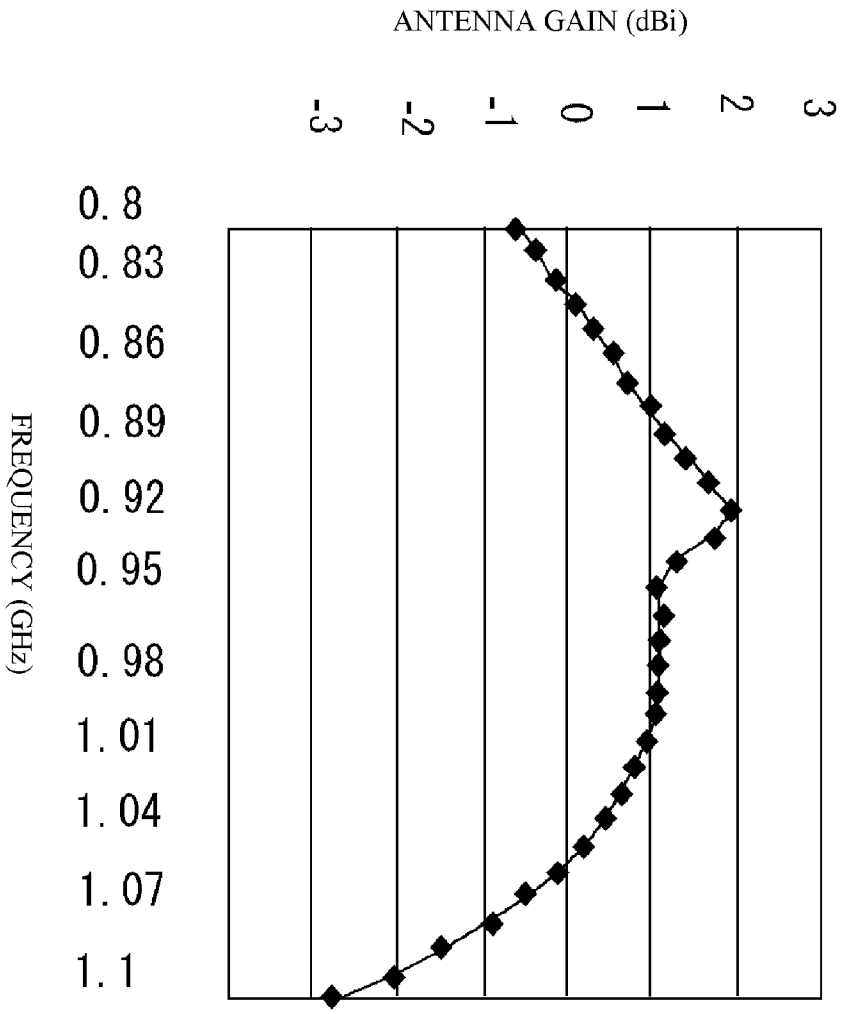
FIG. 12 is a graph of an exemplary antenna gain characteristic of the antenna in accordance with the first embodiment.

FIG. 12 illustrates an antenna gain characteristic of the antenna 200 configured as described above. The antenna 200 has a good gain characteristic over an extremely wide band, as compared to the antenna gain characteristics of the dipole antenna illustrated in FIGS. 2 and 4 and the antenna gain characteristic of the patch antenna having the broadened band illustrated in FIG. 7.

The tag 100 for the RFID systems may be attached to, for example, goods distributed worldwide. Communications between the tag 100 and host computers take place in various areas in the world. The RFID system is assigned a frequency of 860 MHz in Europe, 915 MHz in the United States, and 953 MHz in Japan. The patch antenna illustrated in FIG. 7 is designed to cover all the bands of the above frequencies. However, the antenna gain characteristic of the patch antenna is degraded. Further, the antenna substrate is thick. In contrast, the antenna 200 of the present embodiment covers all the bands and the dielectric substrate 26 is as very thin as 1 mm, and achieves the low profile.

The antenna 200 is the microstrip antenna having the ground electrode on the backside. The antenna 200 has the downsized and thinned structure, and may be attached to a metal member.

Figure 13:
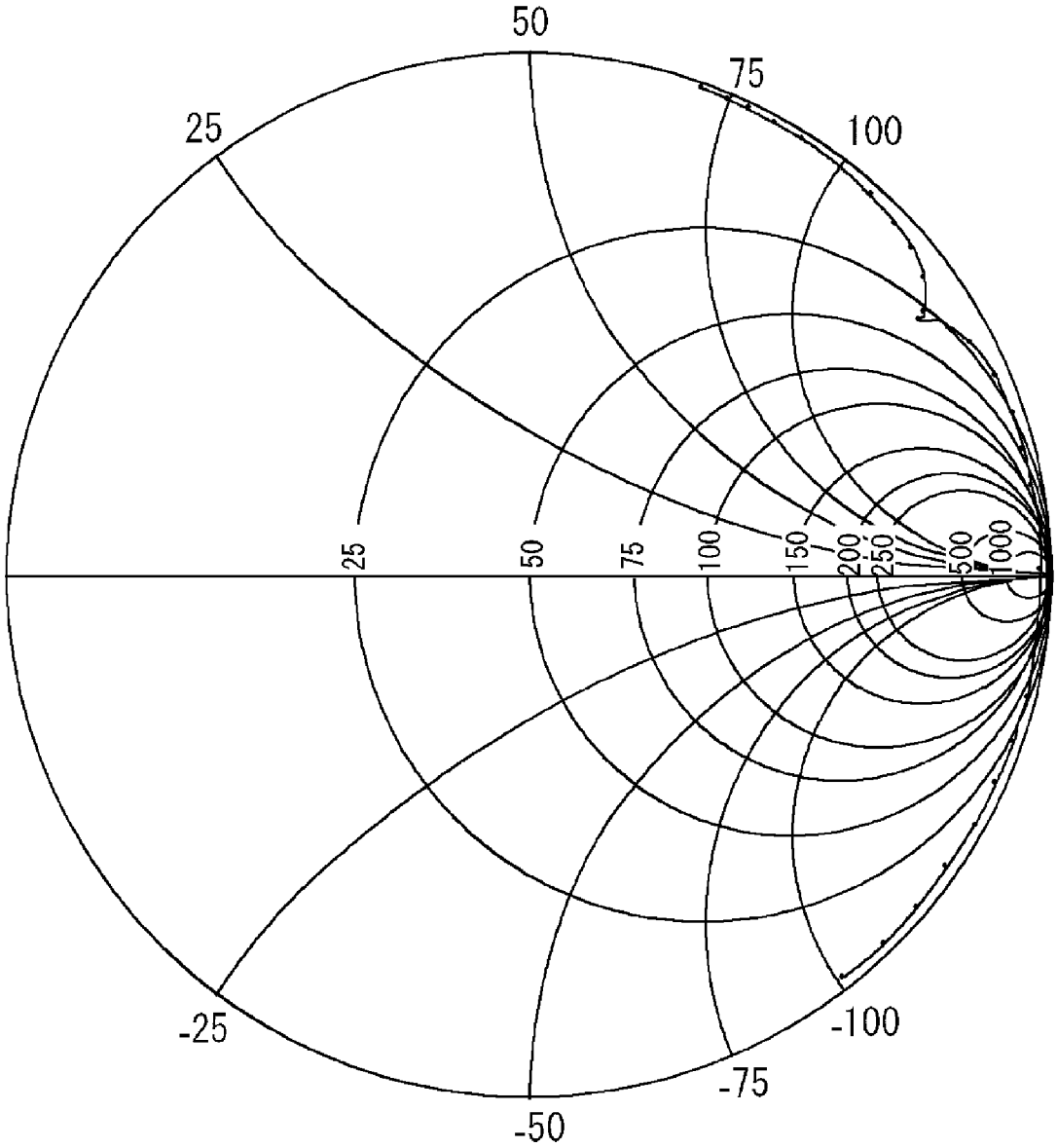
FIG. 13 is a graph of an exemplary input impedance characteristic of the antenna in accordance with the first embodiment.

FIG. 13 illustrates an input impedance characteristic of the antenna 200 depicted in FIG. 11. FIG. 13 may not illustrate any considerable improvement in the input impedance characteristic, as compared to the conventional antenna. However, it is to be noted that the radiation characteristic of antenna is determined by the current distribution on the antenna electrode. Thus, improvements in the antenna gain may not be related to improvements in the input impedance characteristic.

Second Embodiment

Figure 14:
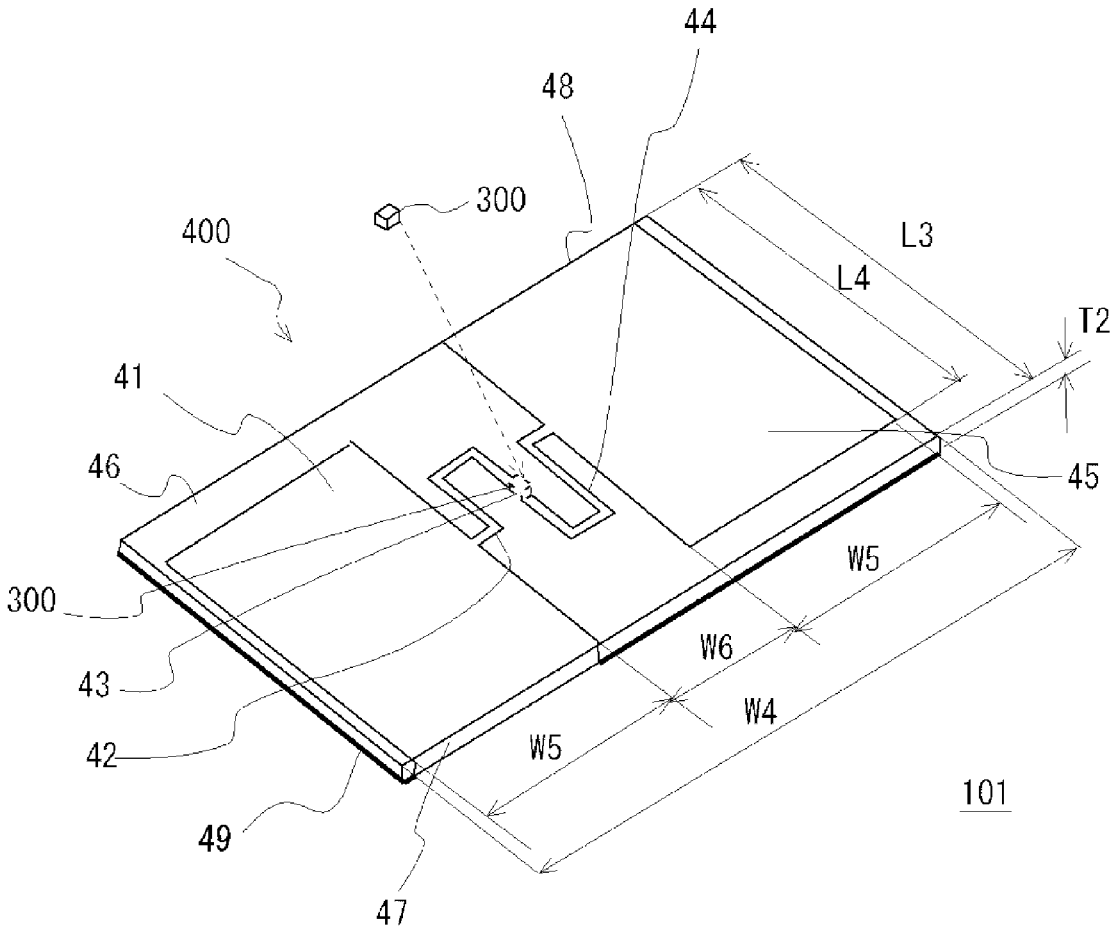
FIG. 14 is a perspective view of a tag employed in an RFID system in accordance with a second embodiment.

A second embodiment is described with reference to FIGS. 14 through 16. FIG. 14 is a perspective view of a tag 101 used for the RFID systems. The tag 101 has an antenna 400 equipped with the LSI chip 300. The tag 101 is an exemplary electronic device. In practice, the tag 101 may be covered with a protection member, which is not illustrated for the sake of simplicity.

The antenna 400 has a dielectric substrate 46 and a ground electrode 29 on a surface of the dielectric substrate 46. The antenna 400 has a first antenna element 41 and a second antenna element 45 provided on the other surface of the dielectric substrate 46. The antenna 400 has a first transmission line 42 and a second transmission line 44 used to connect the first antenna element 41 and the second antenna element 45. The first transmission line 42 extends from the first antenna element 41, and the second transmission line 44 extends from the second antenna element 45. An end of the first transmission line 42 and an end of the second transmission line 44 face each other to thus form a feed part 43. The first antenna element 41 is connected to a ground electrode 49 by an electrode 47 provided on an end of the dielectric substrate 46, and the second antenna element 45 is connected to the ground electrode 49 by an electrode 48 provided on another end of the dielectric substrate 46. The electrodes 47 and 48 are provided on the opposite ends of the dielectric substrate 46. This arrangement of the electrodes 47 and 48 is different from that employed in the first embodiment.

The antenna 400 is similar to the antenna 200 of the first embodiment. However, the antenna 400 has different dimensions from those of the antenna 200. The following are exemplary dimensions of the antenna 400. The length L3 of the dielectric substrate 46 is equal to 30 mm, and the width W4 is equal to 52 mm. The thickness T2 of the dielectric substrate 46 is 1 mm. The length L4 of the first antenna element 41 is equal to 26 mm, and the width W5 is equal to 18 mm. The second antenna element 45 is oriented in a direction opposite to the direction in which the first antenna element 41 is oriented. The first antenna element 41 and the second antenna element 45 have identical dimensions. The distance W6 between the first antenna element 41 and the second antenna element 45 is set equal to 12 mm.

The first antenna element 41 and the second antenna element 45 may satisfy have the following conditions. The first antenna element 41 and the second antenna element 45 are printed on the dielectric substrate 46 and have short-circuited ends and open-circuited ends. The first antenna element 41 having the short-circuited end and the open-circuited end functions as a λ/4 microstrip resonator that resonates at a frequency $f_{R1}$ described below:

$$f_{R1}=c/4(L4+T2)\sqrt{\epsilon_r}$$

where L4+T2 denotes the length of the first antenna element 41, c is the velocity of light and $\epsilon_r$ is the dielectric constant of the dielectric substrate 46. Similarly, the second antenna element 25 functions as a λ/4 microstrip resonator that resonates at a frequency $f_{R2}$ described below:

$$f_{R2}=c/4(L4+T2)\sqrt{\epsilon_r}$$

where L4+T2 denotes the length of the second antenna element 45. Thus, the antenna 400 has a structure with the two λ/4 microstrip resonators. It is noted that the lengths L4+T2 of the first and second antenna elements 41 and 45 consider the thickness of the dielectric substrate 46.

The first antenna element 41 and the second antenna element 45 have the following relations.

$$f_{R1}=f_{R2}$$

$$Q1=Q2$$

Where Q1 is the Q value of the first antenna element 41 and Q2 is the Q value of the second antenna element 45.

The Q value can be written as a general expression as follows:

$$Q=(1/R)\times(L/C)^{1/2}$$

The antenna element functioning as a resonator may be represented in the form of an equivalent circuit in which an inductive element L and a capacitive element C are combined. When the antenna element is considered as a resonator, multiple antenna elements connected by transmission lines function as has been described.

The Q value of the first antenna element 41 is defined by the dimensions of the first antenna element 41, the position of the input/output port, and the thickness of the dielectric substrate 46. Similarly, the Q value of the second antenna element 45 is defined by the dimensions of the second antenna element 45, the position of the input/output port and the thickness of the dielectric substrate 46.

The lengths L4 and the widths W5 of the first and second antenna elements 41 and 45 and the thickness T2 of the dielectric substrate 46 are determined so as to obtain a desired Q value.

The lengths of the first transmission line 42 and the second transmission line 44 used to connect the first antenna element 41 and the second antenna element 45 is λ/4 of the resonance frequencies fR1 and fR2 of the first and second antenna elements 41 and 45 (fR1=fR2).

The position of the feed part 43 is selected so that the antenna is conjugate-matched with the impedance of the signal source. The feed part 43 includes the LSI chip 300 for RFD. The feed part 43 is supplied with power. The antenna 400 forms the tag 101 along with the LSI chip 300 arranged in the feed part 43.

Figure 15:
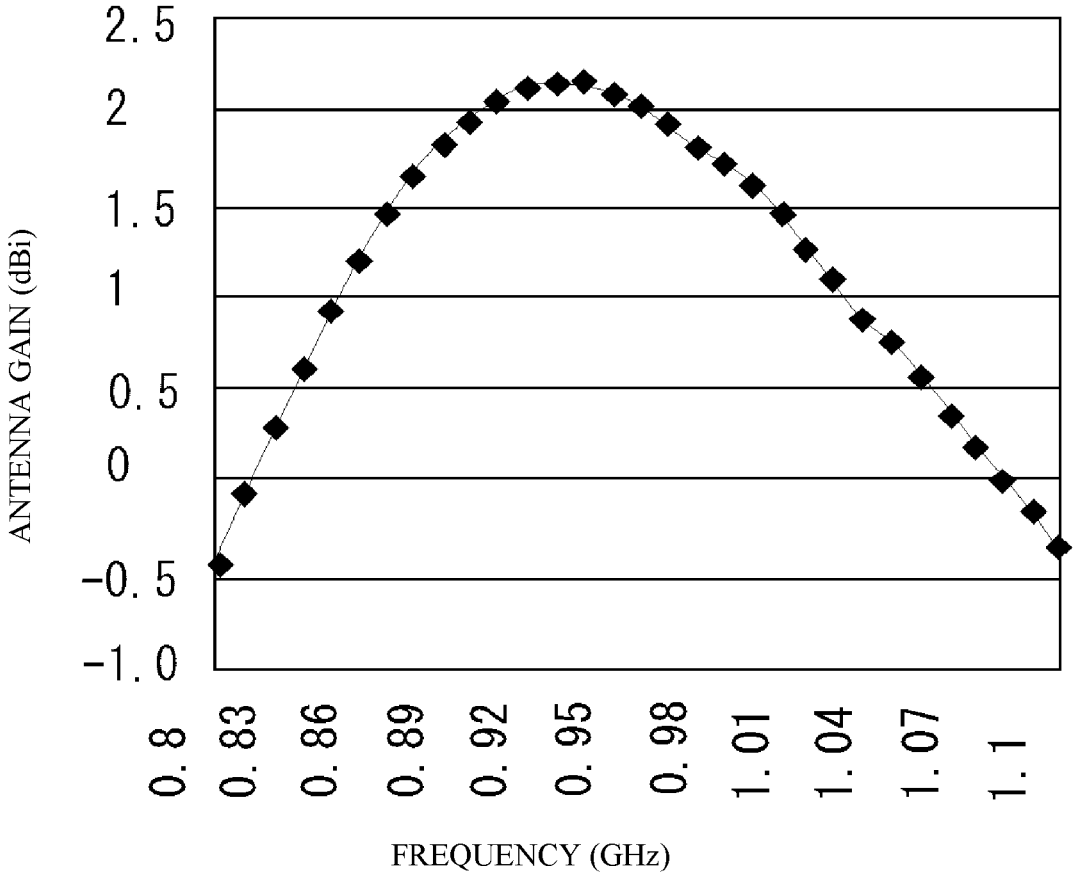
FIG. 15 is a graph of an exemplary antenna gain characteristic of the antenna in accordance with the second embodiment.

FIG. 15 illustrates an antenna gain characteristic of the antenna 400 configured as described above. The antenna 400 has a good gain characteristic over an extremely wide band, as compared to the antenna gain characteristics of the dipole antenna illustrated in FIGS. 2 and 4 and the antenna gain characteristic of the patch antenna having the broadened band illustrated in FIG. 7.

The antenna 400 is the microstrip antenna having the ground electrode on the backside. The antenna 400 has the downsized and thinned structure, and may be attached to a metal member.

Figure 16:
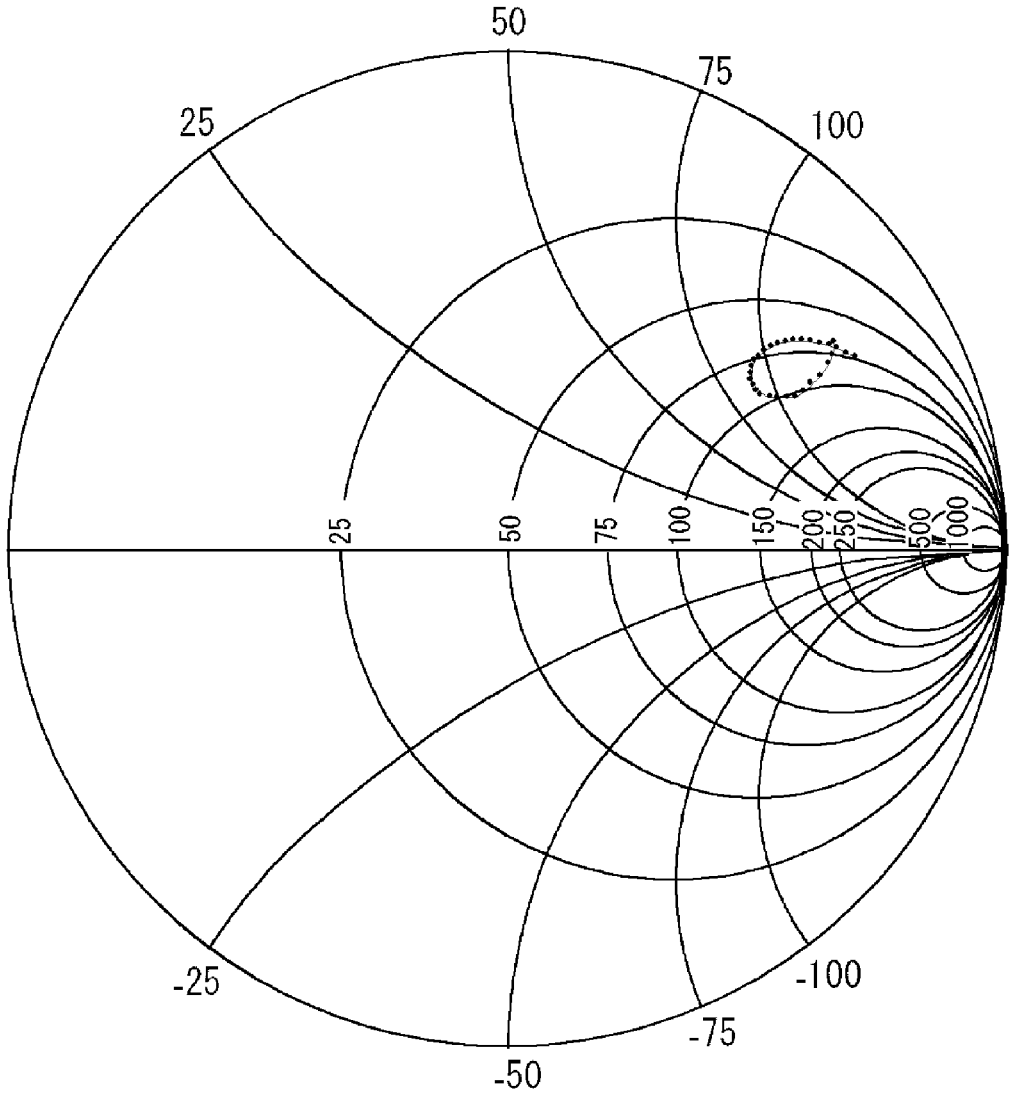
FIG. 16 is a graph of an exemplary input impedance characteristic of the antenna in accordance with the second embodiment.

FIG. 16 illustrates an input impedance characteristic of the antenna 400 depicted in FIG. 14. FIG. 16 may not illustrate any considerable improvement in the input impedance characteristic, as compared to the conventional antenna. However, it is to be noted that the radiation characteristic of antenna is determined by the current distribution on the antenna electrode. Thus, improvements in the antenna gain may not be related to improvements in the input impedance characteristic.

Third Embodiment

Figure 17:
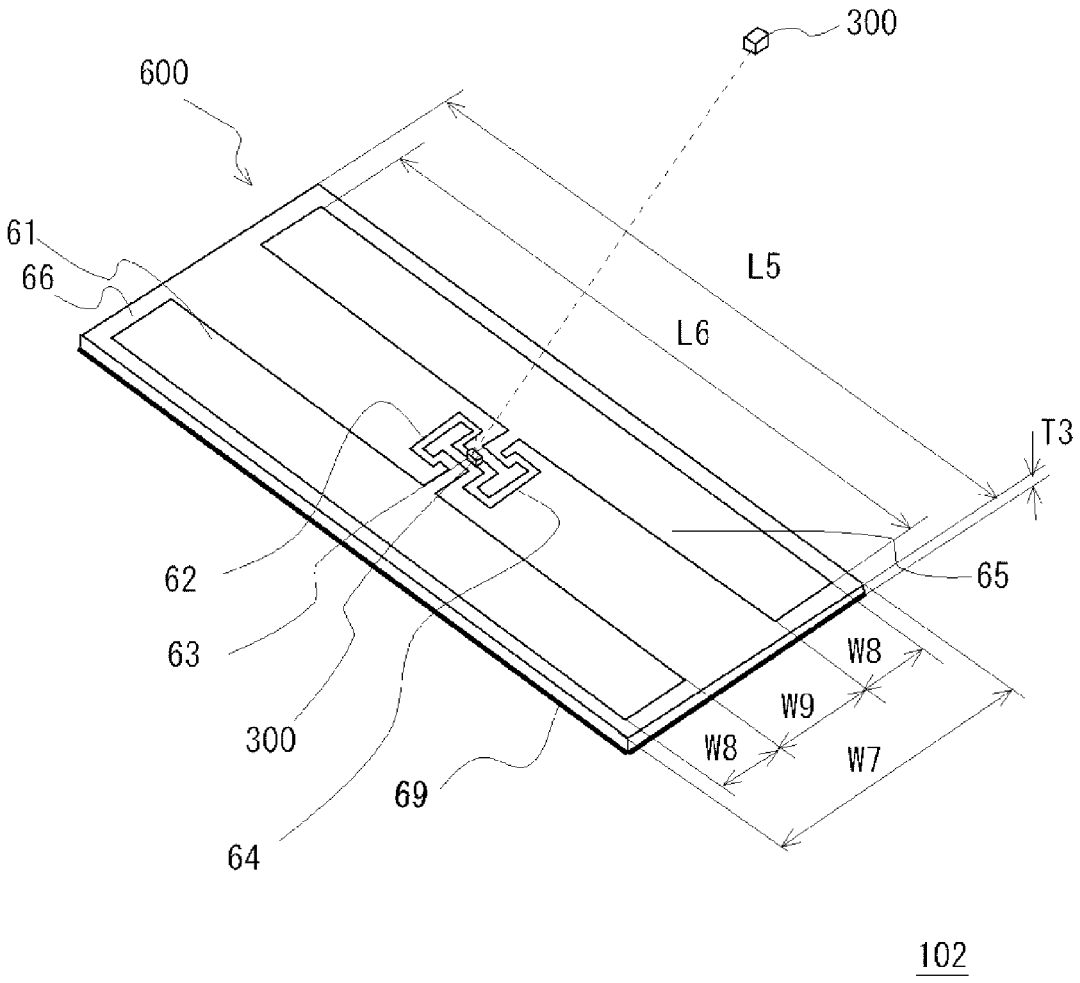
FIG. 17 is a perspective view of a tag employed in an RFID system in accordance with a third embodiment.

A description will now be given, with reference to FIG. 17, of an antenna 600 in accordance with a third embodiment. FIG. 17 is a perspective view of a tag 102 in which the antenna 600 is incorporated. The antenna 600 differs from the antenna 200 of the first embodiment in the following. In the antenna 200, the first antenna element 21 and the second antenna element 25 are printed on the dielectric substrate 26. One end of each of the first and second antenna elements 21 and 25 is short-circuited, and the other is open-circuited. In contrast, the antenna 600 of the third embodiment has a first antenna element 61 and a second antenna element 65, each of which has both ends that are open-circuited. A ground electrode 69 is provided on a surface of the dielectric substrate 66 as in the case of the first embodiment.

For example, the antenna 600 may have the following dimensions. The length L5 of the dielectric substrate 66 is equal to 70 mm, and the width W7 is equal to 40 mm. The thickness T3 of the dielectric substrate 66 is equal to 1 mm. The length L6 of the first antenna element 61 is equal to 66 mm, and the width W8 is equal to 8 mm. The second antenna element 65 has a length L6 of 66 mm, and a width W8 of 8 mm. The second antenna element 65 has the same dimensions as those of the first antenna element 61. There is a distance W9 of 10 mm between the first antenna element 61 and the second antenna element 65.

The first antenna element 61 having the open-circuited ends functions as a λ/2 microstrip resonator that resonates at a frequency fR1 described below:

$$f_{R1}=c/2L6\sqrt{\epsilon_r}$$

where L6 denotes the length of the first antenna element 61, c is the velocity of light and $\epsilon_r$ is the dielectric constant of the dielectric substrate 66. Similarly, the second antenna element 45 functions as a λ/2 microstrip resonator that resonates at a frequency $f_{R2}$ described below:

$$f_{R2}=c/2L6\sqrt{\epsilon_r}$$

where L6 denotes the length of the second antenna element 65. Thus, the antenna 600 has a structure with the two λ/2 microstrip resonators.

The Q value can be written as a general expression as follows:

$$Q=(1/R)\times(L/C)^{1/2}$$

The antenna element functioning as a resonator may be represented in the form of an equivalent circuit in which an inductive element L and a capacitive element C are combined. When the antenna element is considered as a resonator, multiple antenna elements connected by transmission lines function as follows. The antenna element operates as a capacitive element within a range shorter than λ/4 in the distance from the open-circuited end to the input/output port, and operates as an inductive element within a range shorter than λ/4 in the distance from the short-circuited end to the input/output port in accordance with the theory of distribution constant. The characteristic impedance of the antenna element arranged on the dielectric substrate is defined by the dimensions thereof and the thickness of the dielectric substrate.

Thus, the Q value of the first antenna element 61 is defined by the dimensions of the first antenna element 61, the position of the input/output port, and the thickness of the dielectric substrate 66. Similarly, the Q value of the second antenna element 65 is defined by the dimensions of the second antenna element 65, the position of the input/output port and the thickness of the dielectric substrate 66.

The lengths L6 and the widths W8 of the first and second antenna elements 61 and 65 and the thickness T3 of the dielectric substrate 66 are determined so as to obtain a desired Q value.

The lengths of the first transmission line 62 and the second transmission line 64 used to connect the first antenna element 61 and the second antenna element 65 is λ/4 of the resonance frequencies fR1 and fR2 of the first and second antenna elements 61 and 65 (fR1=fR2).

The position of the feed part 63 is selected so that the antenna is conjugate-matched with the impedance of the signal source. The feed part 63 includes the LSI chip 300 for RFID. The feed part 63 is supplied with power. The antenna 600 forms the tag 102 along with the LSI chip 300 arranged in the feed part 63.

The antenna 600 is the microstrip antenna having the ground electrode on the backside. The antenna 600 has the downsized and thinned structure, and may be attached to a metal member.

Figure 18:
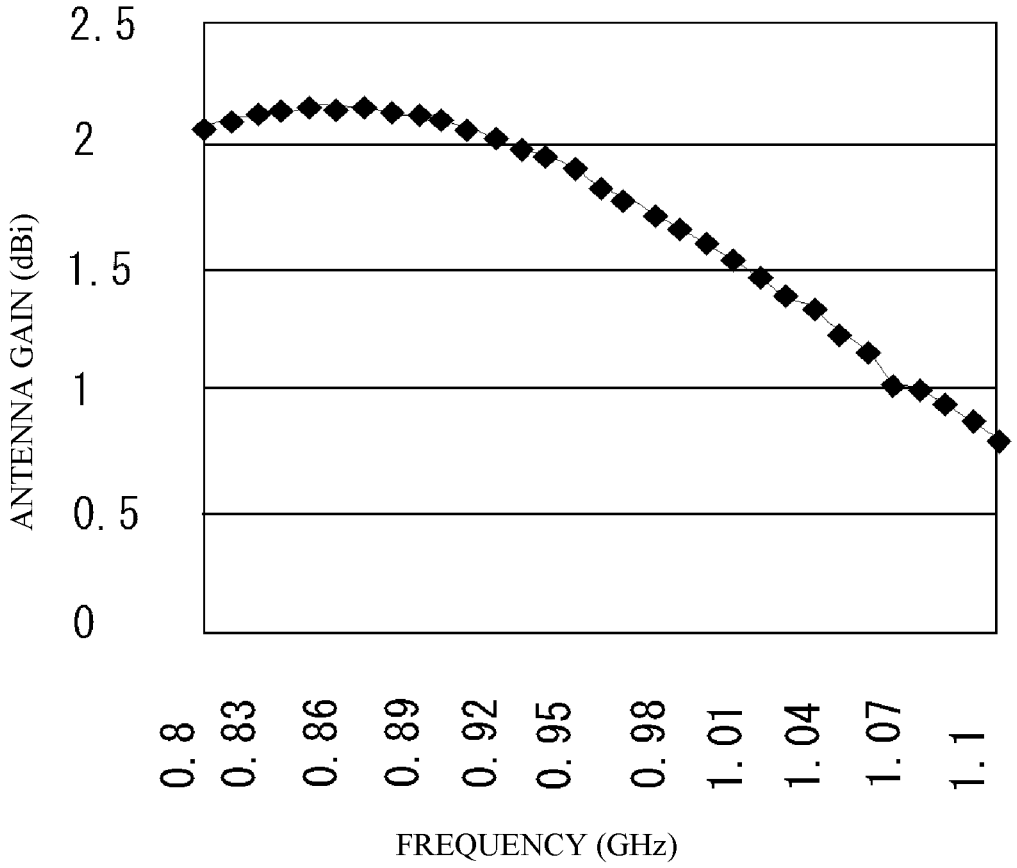
FIG. 18 is a graph of an exemplary antenna gain characteristic of the antenna in accordance with the third embodiment.

FIG. 18 illustrates an antenna gain characteristic of the antenna 600 configured as described above. The antenna 600 has a good gain characteristic over an extremely wide band, as compared to the antenna gain characteristics of the dipole antenna illustrated in FIGS. 2 and 4 and the antenna gain characteristic of the patch antenna having the broadened band illustrated in FIG. 7. Further, the dielectric substrate 66 is as very thin as 1 mm, and achieves the low profile.

Figure 19:
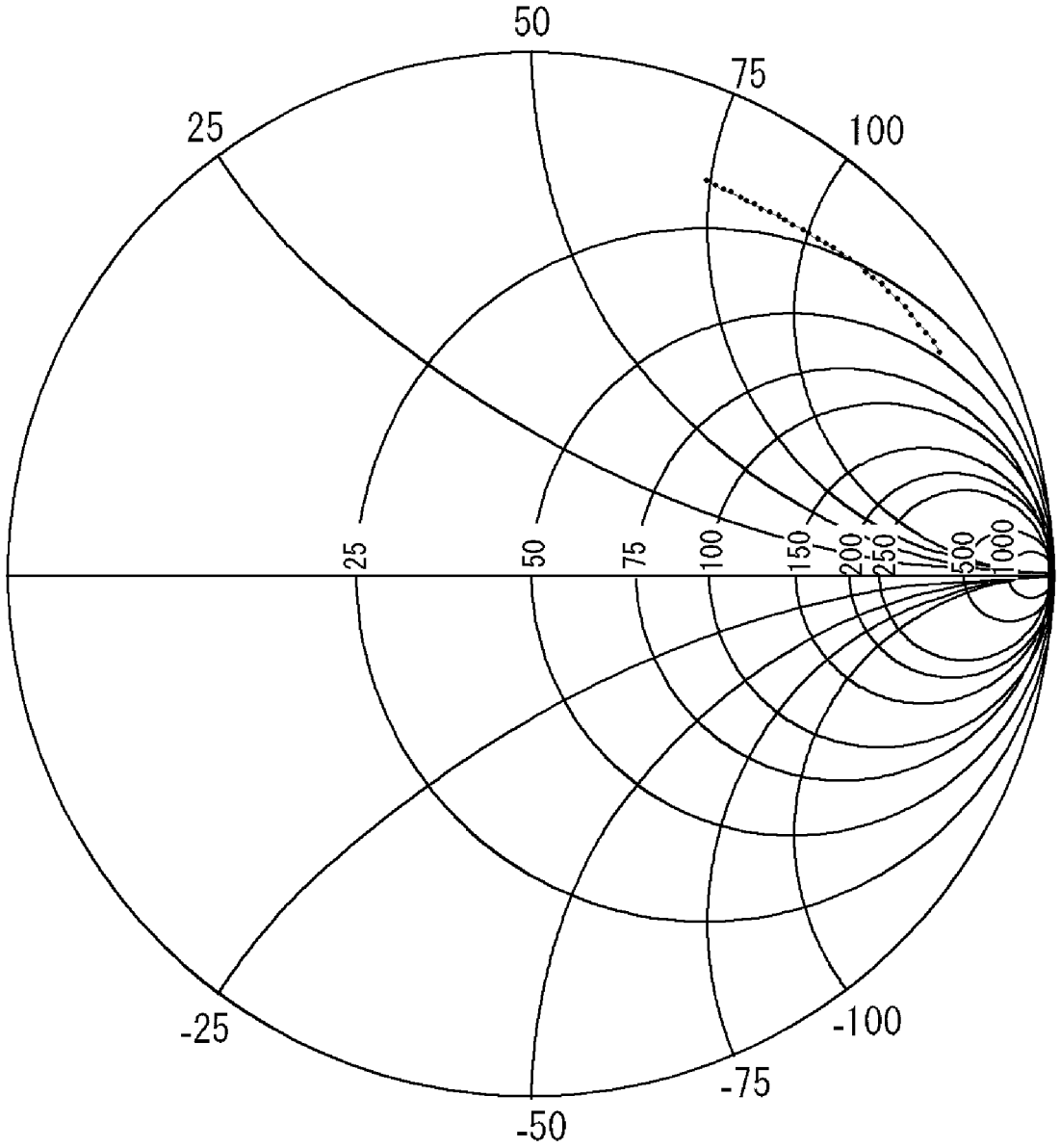
FIG. 19 is a graph of an input impedance characteristic of the antenna in accordance with the third embodiment.

FIG. 19 illustrates an input impedance characteristic of the antenna 600 depicted in FIG. 17. FIG. 19 may not illustrate any considerable improvement in the input impedance characteristic, as compared to the conventional antenna. However, it is to be noted that the radiation characteristic of antenna is determined by the current distribution on the antenna electrode. Thus, improvements in the antenna gain may not be related to improvements in the input impedance characteristic.

Figure 20:
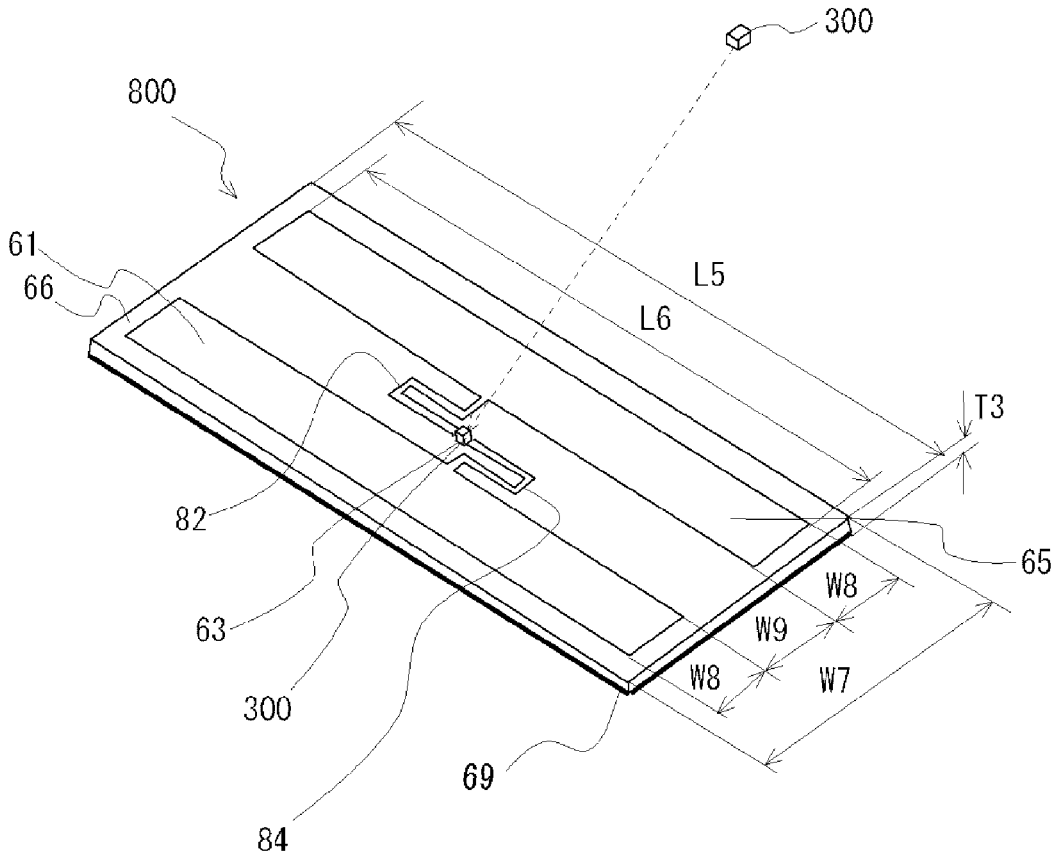
FIG. 20 is a perspective view of another tag for an RFID system.

FIG. 20 illustrates an antenna 800 that corresponds to a variation of the antenna 600. The antenna 800 has a first transmission line 82 and a second transmission line 84, that are substituted for the first transmission line 62 and the second transmission line 64. The other structural elements of the antenna 800 are the same as those of the antenna 600. The first transmission line 82 and the second transmission line 84 are arranged alternately or are symmetrical about the feed part 63. The antenna 800 thus configured exhibits the good antenna characteristic similar to that of the antenna 600 as long as the conditions related to the aforementioned resonance frequency and the Q value are met. The antenna 800 is capable of covering the different frequency bands of the RFID systems employed in the various countries.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. An antenna comprising:

a dielectric substrate;

a ground electrode provided on a first surface of the dielectric substrate;

a first antenna element and a second antenna element provided to a second surface of the dielectric substrate, the first antenna element having rectangular shape, the second antenna element having rectangular shape and placed opposite to the first antenna element, each of the first and second antenna element connected to the ground electrode via an electrode provided on an end of the dielectric substrate, each of the first and second antenna element having a short-circuited end and an open-circuited end, each of the first and second antenna element having shape so that a resonance frequency and a Q value of the first antenna element are same as those of the second antenna element;

a transmission line connecting a side of each of the first antenna element and the second antenna element, the side of the first antenna element and the side of the second antenna element are located between the short-circuited end and the open-circuited end respectively, and are placed opposite with respect to one another; and a feed part provided in the transmission line.

2. An electronic device comprising:

a dielectric substrate;

a ground electrode provided on a first surface of the dielectric substrate;

a first antenna element and a second antenna element provided to a second surface of the dielectric substrate, the first antenna element having rectangular shape, the second antenna element having rectangular shape and placed opposite to the first antenna element, each of the first and second antenna element connected to the ground electrode via an electrode provided on an end of the dielectric substrate, each of the first and second antenna element having a short-circuited end and an open-circuited end, each of the first and second antenna element having shape so that a resonance frequency and a Q value of the first antenna element are same as those of the second antenna element;

a transmission line connecting a side of each of the first antenna element and the second antenna element, the side of the first antenna element and the side of the second antenna element are located between the short-circuited end and the open-circuited end respectively, and are placed opposite with respect to one another;

a feed part provided in the transmission line; and a circuit chip provided on the dielectric substrate and connected to the feed part.

* * * * *